United States Patent [19]

Gruchalski et al.

[11] Patent Number: 4,802,393

[45] Date of Patent: Feb. 7, 1989

[54] PIERCING DIE

[75] Inventors: Henry Gruchalski; Albert Gruchalski, both of Bensenville, Ill.

[73] Assignee: Ecological Systems, Inc., Chicago, Ill.

[21] Appl. No.: 926,953

[22] Filed: Nov. 4, 1986

[51] Int. Cl.[4] ..... B21D 28/28; B26F 1/14

[52] U.S. Cl. ..... 83/184; 83/191; 83/195; 83/374; 83/553; 83/588; 83/635; 83/690; 83/733

[58] Field of Search ..... 83/128, 129, 188, 184, 83/191–195, 267, 566–570, 549, 553, 588, 635, 690, 694, 733

[56] References Cited

U.S. PATENT DOCUMENTS

| | | | |
|---|---|---|---|
| 1,398,320 | 11/1921 | Dunsworth . | |
| 1,502,097 | 7/1924 | Grace | 83/191 |
| 1,503,551 | 8/1924 | Nice . | |
| 1,549,462 | 8/1925 | De Wyk | 83/191 |
| 1,581,810 | 4/1926 | Patrick . | |
| 2,315,340 | 3/1943 | Knudsen . | |
| 2,326,536 | 8/1943 | Hartsock et al. . | |
| 2,329,020 | 9/1943 | Wales . | |
| 2,419,534 | 4/1947 | Burleson . | |
| 2,423,791 | 7/1947 | Nelson . | |
| 2,630,862 | 3/1953 | Musser et al. . | |
| 2,875,829 | 3/1959 | Patrick . | |
| 3,286,570 | 11/1966 | Roper . | |
| 3,374,697 | 3/1968 | Robinson . | |
| 3,473,425 | 10/1969 | Foist et al. | 83/129 |
| 3,485,124 | 12/1969 | Merchant | 83/182 |
| 3,557,649 | 1/1971 | Kirchner | 83/54 |
| 3,579,767 | 5/1971 | Reider | 83/194 |
| 3,580,122 | 12/1968 | Powell | 83/108 |
| 3,756,108 | 9/1973 | Fuchs, Jr. | 83/193 |
| 3,782,231 | 1/1974 | Jannetty | 83/143 |
| 3,949,632 | 4/1976 | Kapaan | 83/188 |
| 4,269,094 | 5/1981 | Long et al. | 83/188 |
| 4,524,661 | 6/1985 | Leibinger | 83/690 |
| 4,633,744 | 1/1987 | Maurer | 83/188 |

FOREIGN PATENT DOCUMENTS

| | | | |
|---|---|---|---|
| 206523 | 2/1968 | U.S.S.R. | 83/191 |

*Primary Examiner*—Donald R. Schran
*Assistant Examiner*—Hien H. Phan
*Attorney, Agent, or Firm*—Y. Judd Azulay

[57] ABSTRACT

The subject piercing die is particularly adapted for piercing a hole in a blank having an open interior and an outer wall defining a closed figure. The piercing is done from the interior of the blank through the wall to the outside of the blank. The piercing die includes a base with a slide movably mounted on the base. A guide is movably connected to the slide to control movement of the slide to a straight line movement. A female die having a blank receptacle for holding the blank is mounted on the base. The female die has a cutting aperture extending through a portion of the female die and intersecting the blank receptacle. A male die is mounted on the slide and is positioned within the blank receptacle for mating with the cutting aperture to cut a hole in a blank positioned in the receptacle. The male die cuts a hole in the blank from the interior of the blank through the outer wall to the outside of the blank. A cam is connectable to the slide for moving the male die toward the female die to engage the blank and to cut the hole in the blank.

20 Claims, 3 Drawing Sheets

FIG. 1
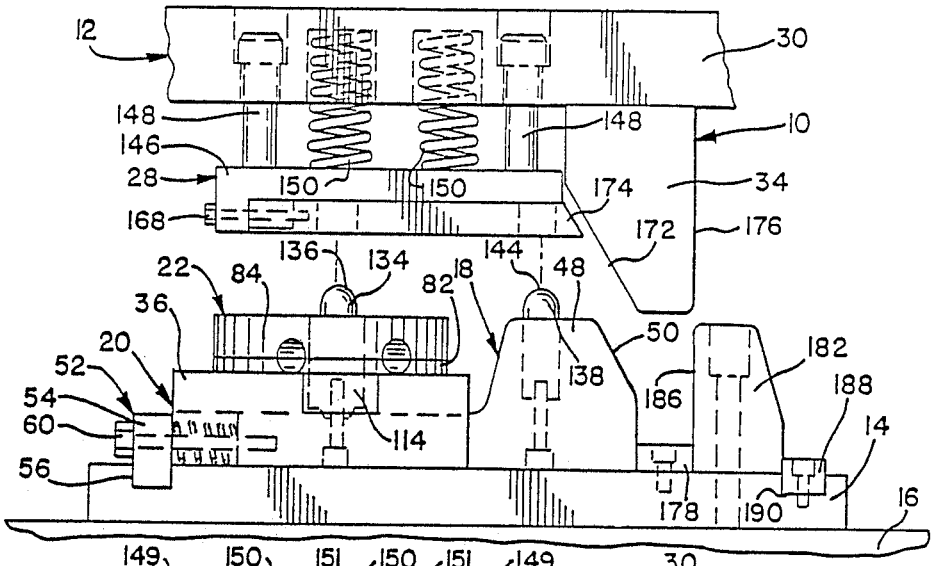
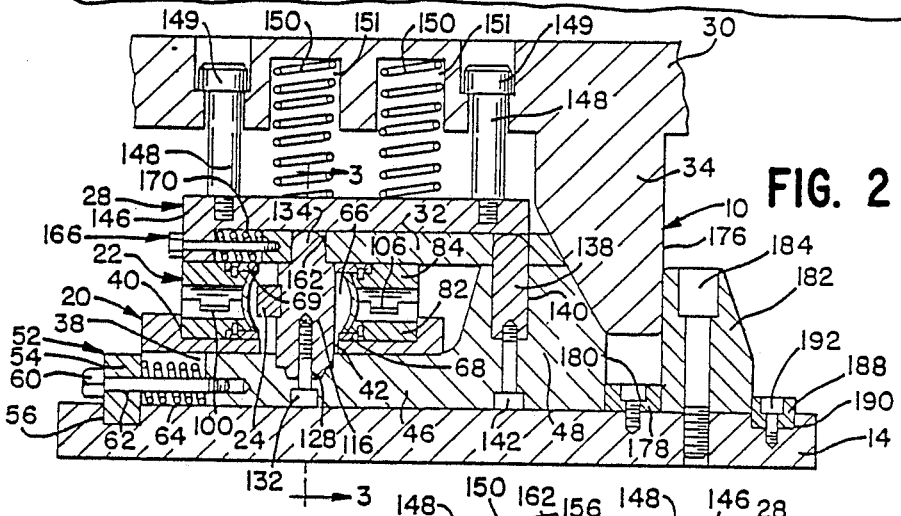
FIG. 2
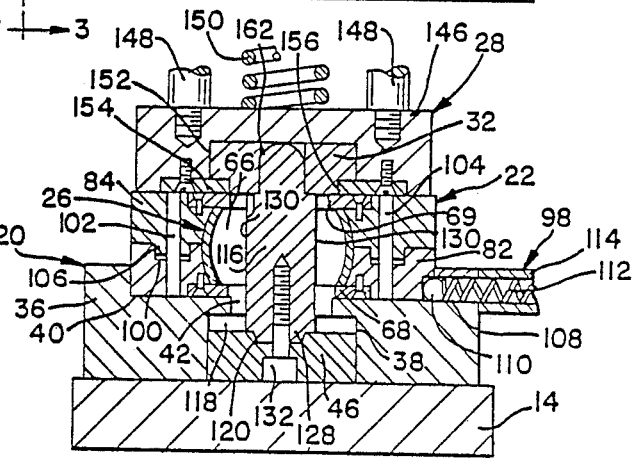
FIG. 3

FIG. 4
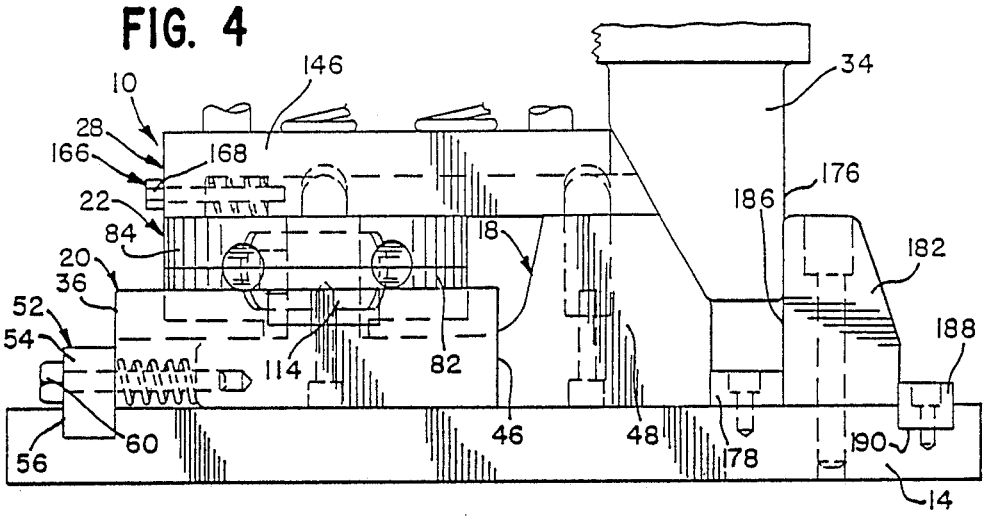
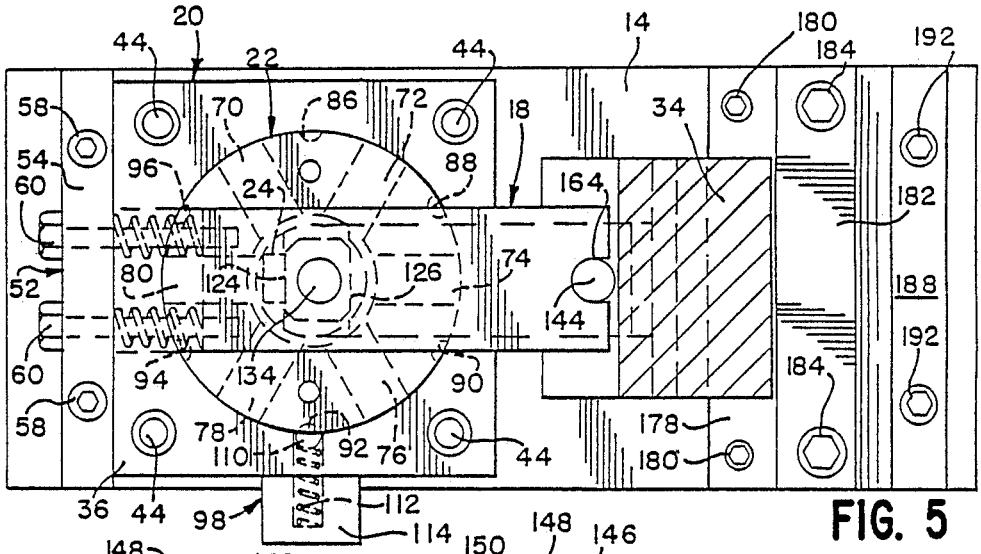
FIG. 5
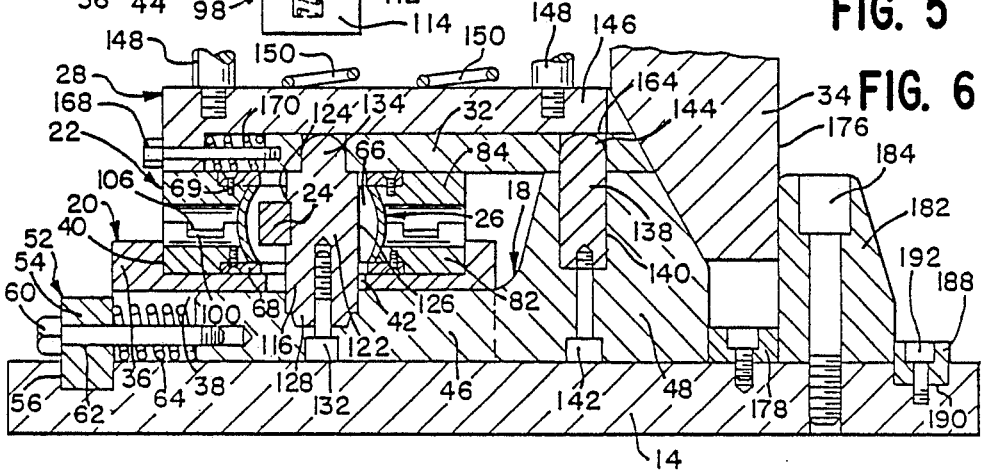
FIG. 6

PIERCING DIE

BACKGROUND OF THE INVENTION

In the manufacture of certain parts, it is desirable to pierce a hole through a part as opposed to using a rotary cutting technique, such as, drilling or boring. The piercing of a part is customarily done on a press and in particular a power press. The piercing of a hole in a workpiece which has an open interior is usually accomplished by providing a die or mandrel and forcing a die through the blank from the outside of the workpiece or blank toward the interior. Examples of mechanisms which utilize this type of piercing operation are shown in the following patents: U.S. Pat. No. 1,398,320, to G. W. Dunsworth, issued Nov. 29, 1921, entitled, "Pipe Perforator"; U.S. Pat. No. 1,503,551, to B. G. Nice, issued Aug. 5, 1924, entitled "Band Punching Machine"; U.S. Pat. No. 1,581,810, to I. Patrick, issued Apr. 20, 1926, entitled, "Machine For Punching Or Swaging Rims Or The Like"; U.S. Pat. No. 2,315,340, to A. W. Knudsen, issued Mar. 30, 1943, entitled, "Punch"; U.S. Pat. No. 2,326,536, to G. M. Hartsock et al., issued Aug. 10, 1943, entitled, "Machine For Piercing Tubes"; U.S. Pat. No. 2,329,020, to G. F. Wales, issued Sept. 7, 1943, entitled, "Punching Device"; U.S. Pat. No. 2,419,534, to H. A. Burleson, issued Apr. 29, 1947, entitled, "Demountable Device For Punching Tubes"; U.S. Pat. No. 2,423,791, to J. V. Nelson, issued July 8, 1947, entitled, "Dies And The Like"; U.S. Pat. No. 2,630,862 to C. W. Musser et al., issued Mar. 10, 1953, entitled, "Apparatus For Perforating Hollow Cylindrical Objects"; U.S. Pat. No. 2,875,829, to B. S. Patrick, issued Mar. 3, 1959, entitled, "Apparatus For Stamping Surfaces"; U.S. Pat. No. 3,286,570, to R. E. Roper, issued Nov. 22, 1966, entitled, "Apparatus For Forming Metallic Sheet Members"; U.S. Pat. No. 3,374,697, to W. S. Robinson, issued Mar. 26, 1968, entitled, "Method And Apparatus For Severing A Tubular Member"; U.S. Pat. No. 3,485,124, to C. O. Merchant, issued Dec. 23, 1969, entitled, "Automatic Machine For Making Convergence Cup Electrodes For Color Television Tubes"; U.S. Pat. No. 3,557,649, to M. C. Krchner, issued Jan. 26, 1971, entitled, "Centering And Piercing Process And Apparatus"; U.S. Pat. No. 3,579,767, to O. E. Reider, issued May 25, 1971, entitled, "Method For Forming Flash Holes In Cartridge Cases"; U.S. Pat. No. 3,580,122, to J. C. Powell, issued May 25, 1971, entitled, "Apparatus For Making Knockouts In Electrical Boxes Formed Of Plastic Material"; U.S. Pat. No. 3,756,108, to F. J. Fuchs, issued Sept. 4, 1973, entitled, "Tube Cutter"; U.S. Pat. No. 3,782,231, to L. F. Jannetty, issued Jan. 1, 1974, entitled, "Piercing Assembly"; U.S. Pat. No. 3,949,632, to H. J. Kapaan, issued Apr. 13, 1976, entitled, "Tube Cut-Off Machine"; and U.S. Pat. No. 4,269,094, to K. M. Long et al., issued May 26, 1981, entitled, "Device For Punching Holes In Tubing".

In certain instances, it is desirable to cut a hole in a workpiece wherein the material from the interior of the workpiece is pushed out to the outside of the workpiece. This type of operation requires an apparatus which has a male die positionable within the interior of the workpiece. When a press is used to move the die as is conventional, it is necessary to provide the apparatus for transmitting the force from the press to the die. It is therefore an object of the present invention to provide a piercing die construction which is mountable on a press and the press is utilized to force a die through a closed figure open interior blank from the interior of the blank to the outside surface of the blank.

SUMMARY OF THE INVENTION

The instant invention provides an improved piercing die for piercing a hole in a blank having an open interior and an outer wall defining a closed figure. The hole is cut from the interior of the blank out through the outer wall to the outside of the blank. The piercing die includes a base adapted for mounting on a bed of a power press. A slide is movably mounted on the base. A guide is mounted on the base and is movabbly connected to the slide to control movement of the slide to a straight line movement. A female die having a blank receptacle for holding a blank is mounted on the base. The female die has a cutting aperture formed therein intersecting the blank receptacle. A male die mateable with the cutting aperture is mounted on the slide. The male die is positioned within the blank receptacle. The male die is movable toward the blank to cut a hole in the blank from the interior of the blank toward the outer wall to the outside of the blank. A cam is adapted for connection to a ram of the power press for moving with the ram. THe cam is connectable to the slide for moving the male die toward the cutting aperture of the female die to engage the blank for cutting the hole in the blank from the interior of the blank to the outside wall.

DESCRIPTION OF THE DRAWINGS

FIG. 1 is a side elevational view of a piercing die embodying the herein disclosed invention shown mounted in a conventional power press;

FIG. 2 is a cross sectional view of the piercing die shown mounted in the power press but with a ram of the press in a partially lower position;

FIG. 3 is a cross sectional end view of the piercing die of FIG. 1 taken on Line 3—3 of FIG. 2;

FIG. 4 is a side elevational view of the piercing die of FIG. 1 showing the ram of the press in a partially lowered position;

FIG. 5 is a plan view of the piercing die of FIG. 1;

FIG. 6 is a cross sectional view of the piercing die in the attitude shown in FIG. 4;

DESCRIPTION OF THE PREFERRED EMBODIMENT

Figure 7:
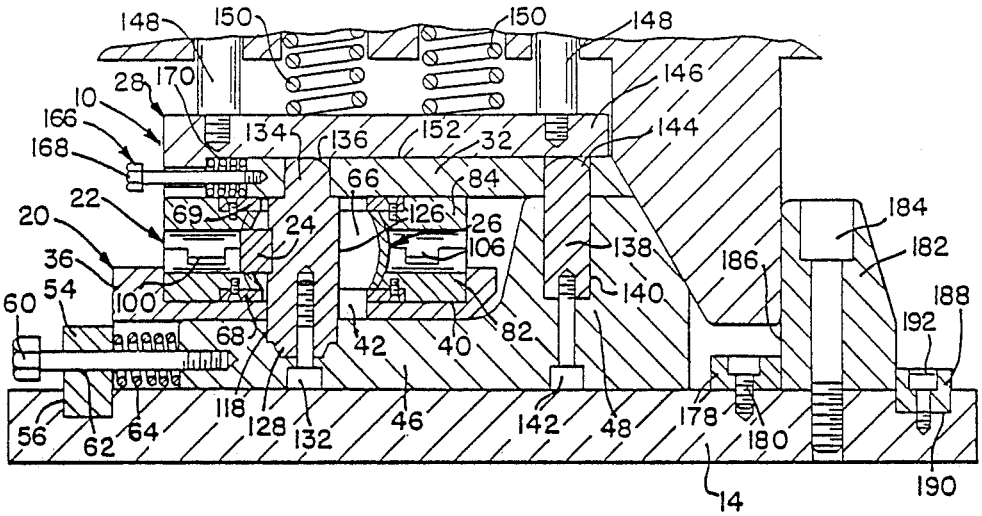
FIG. 7 is a cross sectional view similar to FIG. 6 but showing the male die having pierced a hole in a blank.
Figure 8:
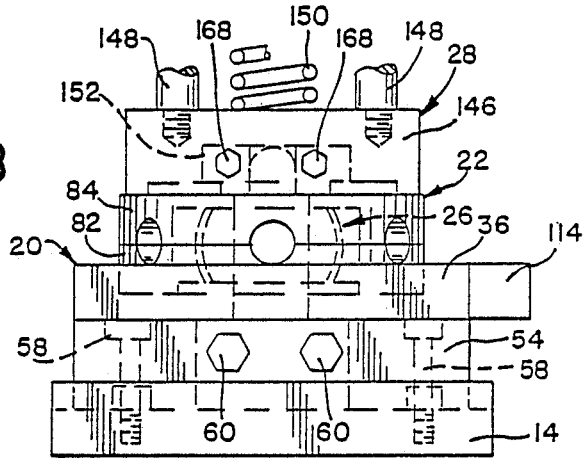
FIG. 8 is an end elevational view of the die of FIG. 1.

Referring now to the drawings, a piercing die, embodying the instant invention, is generally indicated by numeral 10. Piercing die 10 is mounted in a conventional power press 12. The piercing die generally includes a substantially flat base 14 adapted for conventional mounting on a bed 16 of press 12. A slide 18 is slideably mounted on base 14 and is restricted to a straight line movement by a fixed guide 20. A female die 22 is rotatably supported on guide 20. A male die 24 is connected to slide 18 and is positioned inside of the female die. The male die is cooperative with female die 22 for piercing a hole through a workpiece blank 26. A head 28 is connected to a conventional ram 30 of press 12. A sliding guide 32 is slideably mounted in head 28 for limiting movement of the male die in cooperation with the slide and guide 20. Slide 18 is connectable to a cam 34 mounted on ram 30 for moving the slide in one direction for piercing a hole in blank 26.

Guide 20 has a generally rectangular body 36 with a slot 38 contained therein receiving slide 18. The guide includes a circular die recess 40 for receiving female die 22. An aperture 42 is formed in the guide to provide communication between slot 38 and the die recess 40. The guide is secured to base 14 by four identical pins 44.

Slide 18 includes a foot 46 mounted on base 14. The foot is slideable within slot 38 of the guide. The foot has a heel 48 formed integral therewith which heel has a cam surface 50 on one side engageable with cam 34.

A slide return 52 is connected to slide 18. The slide return includes a slide return bar 54 which is mounted in a slide return bar groove 56. The slide return bar groove 56 is formed in base 14 and is generally perpendicular to the direction of travel of slide 18. A pair of screws 58 hold bar 54 in groove 56. A pair of spring pins 60 is slideably mounted in openings 62 to stop bar 48. The pins are threadedly mounted in the end of foot 46 of slide 18. A spring 64 is mounted on each of the spring pins 60. The springs 64 are positioned between stop bar 54 and the end of foot 46 so that the springs constantly urge the slide away from the stop bar and toward cam 34.

Female die 22 is rotatably mounted in circular die recess 40. The female die includes a blank receptacle 66 which is formed in the center of the female die. The wall of the female die forming the wall of the blank receptacle is a portion of a sphere having its center at the center of the female die. The blank receptacle includes a lower annular ledge 68 for supporting the blank. An upper annular lip 69 holds the blank against rising during working of the blank. Six die apertures 70, 72, 74, 76, 78 and 80 are formed in the female die extending radially from the blank receptacle to the outer wall of the female die. Each of the die apertures has a circular cross section and is mateable with the male die. The die apertures are equiangularly positioned relative to each other about a center which is at the center of the blank receptacle. The female die is split into a lower plate 82 and an upper plate 84. The split of the female die into the two plates occurs on a plane which is substantially parallel to the base and extends through the center of each of the die apertures. The lower plate has formed on its outer periphery six position indentations 86, 88, 90, 92, 94 and 96 which are equiangularly spaced from each other. These position indentations are cooperative with a die position assembly 98 for positioning each of the die apertures with the male die as will be described hereinafter. The lower plate also includes an annular die groove 100 for positioning the upper plate relative to the lower plate. A pair of die pins 102 and 104 also position the die plates relative to each other in that die pins 102 and 104 prevent the plates from rotating relative to each other, thereby maintaining the plates in alignment to keep the die apertures as circular apertures.

Upper plate 84 includes an integral die ring 106 which is mateably positioned in annular die groove 100. The mating of the die ring with the annular die groove holds the plates in firm position in cooperation with the die pins which prevent rotation of the upper and lower plates relative to each other.

Die position assembly 98 positions the die apertures relative to the male die. The die position assembly includes a spring aperture 108 in body 36 of guide 20. A ball 110 is positioned in the spring aperture and is engageable with the lower plate at the position indentations for releasably holding the female die against rotation in the recess. A position spring 112 is mounted in the aperture in engagement with ball 110 to urge the ball toward the female die. A cap 114 is fixed to the guide body to hold the spring in position. The indentations are positioned relative to the die apertures so that as the female die is rotated, the ball drops into a position indentation to hold the female die in a position with a selected die aperture aligned with the male die.

Male die 24 which has a circular cross section and is mateable with the die apertures is mounted on a male die support 116. The male die support is fixed to foot 46 of slide 18. Foot 46 has a transverse groove 118 with a circular recess 120 in the groove formed in the upper surface of the foot. The male die support includes a post 122 which has a pair of opposed flat faces 124 and 126. Male die 24 is fixed to face 124 at the midportion of the post. The flat faces have their lower portions positioned in groove 118. Post 122 includes a boss 128 formed in its bottom, which boss is mateably positioned in recess 120. Post 122 has a pair of parallel sides 130. A conventional machine screw 132 is fixed in foot 46 to fix post 122 to foot 46. A guide stud 134 is formed integral with the top of the post. The guide stud has a domed upper portion 136 to facilitate connection with the sliding guides.

A guide pillar 138 is mounted in heel 48. Heel 48 has a pillar aperture 140 which receives the guide pillar. A conventional screw 142 secures the guide pillar in aperture 140. The guide pillar has a domed pillar head 144 similar to the domed head 136 of guide stud 134. The guide stud and the guide pillar are aligned with each other and with slot 38 of guide 20 to guide slide 18 in a straight line.

Head 28 includes a head body 146 which has four head pins 148 threadedly connected thereto. The head pins are slideably mounted in ram 30 and are held in the ram by their respective heads 149. A pair of ocil springs 150 is positioned in respective spring sockets 151 in ram 30 and in engagement with head body 146 constantly urging the head body away from ram 30. However, the movement of the head away from the ram is limited by the head pins. A guide groove 152 is formed in the underside of the head body. A pair of guide supports 154 and 156 is secured to the head body and partially overlap the guide groove. Sliding guide 32 is slideably mounted in guide groove 152. Sliding guide 32 includes an elongated guide runner 160 which has a generally T-shaped cross section. The T-shaped cross section allows the sliding guide to fit in the guide groove 152 and have guide supports 154 and 156 hold the sliding guide within the head. The sliding guide includes a forward opening 162 adapted to receive guide stud 134 and a rear slot 164 adapted to receive guide pillar 138. A guide return assembly 166 is connected to sliding guide 32. The guide return assembly includes a pair of guide pins 168 which are threadedly mounted in one end of guide runner 160. A guide return spring 170 is mounted on each of the guide pins and each spring is positioned between the end of guide runner 160 and a portion of head 128 to urge the sliding guide toward the cam.

Cam 34 is fixed to ram 30 and moves vertically with the ram. Cam 34 includes a cam face 172 which is engageable with cam surface 50 of heel 48. Cam face 172 is also engageable with a surface 174 of guide runner 160. The cam also has a back face 176 which is adapted for holding the cam in a horizontal direction.

A slide stop 178 is secured to base 14 by a pair of conventional machine screws 180. A cam wall 182 is secured to base 14 by a pair of machine screws 184. The cam wall includes a cam wall surface 186 which is engageable with back face wall 176 of the cam. A cam wall stop 188 is mounted in a cam wall stop groove 190 in base 14. The cam wall stop is held in position by a pair of conventional screws 192 to secure the cam wall against movement relative to the base.

The workpiece or blank 26 is, in this instance, made of cold rolled steel. The blank is a continuous closed figure having a hollow center. The blank has its outer surface formed as a portion of a sphere and the inner surface is also a portion of a sphere.

The blank receptacle 66 of the female die conforms to the outer surface of the blank. As was mentioned above, the female die is split on a plane extending through the center of the die apertures. The blank is inserted into the blank receptacle by first lifting upper plate 84 off of lower plate 82 and positioning the blank in the blank receptacle with the male die and male die support within the open interior of the blank. The upper plate 84 is then placed on the lower plate to complete blank receptacle 66.

In order to pierce the blank, the conventional power press 12 is operated as is conventional. After the upper plate is placed into position, the ram is brought down toward the femal die. The guide stud and the guide pillar mate with the forward opening and rear slot, respectively, so that the sliding guide is connected to the guide stud and guide pillar for guiding the male die in a straight line which is on the same straight line as that which the slot 38 in body 36 guides the male die through the cooperation of body 36 with slide 18.

Ram 30 in conventional operation moves down until head 28 engages the upper surface of upper plate 84 of the female die. The engagement of the head with the female die secures the female die into position and holds the upper plate in tight engagement with the lower plate. Simultaneous with the downward movement of the head into engagement with the upper plate, cam 34 moves downward so that cam surface 172 engages the surface 174 of sliding guide 158 and cam surface 50 of the slide while back force 176 engages cam wall surface 186. Continued movement of cam 34 downward moves the slide toward the left as viewed in FIGS. 6 and 7. The movement of the slide is against the force of springs 64 and moves the male die toward the blank. The male die engages the blank and forces the metal of the blank out through die aperture 80. Movement of the cam is restricted to a vertical movement since the cam wall 182 prevents the cam from moving to the right as viewed in FIGS. 6 and 7. Once the male die has completed its cut through the workpiece, a slug, which is the metal cut out of the blank, is forced out through the die aperture. The movement of the slide is restricted to a straight line movement by slot 38 in the guide body and sliding guide 158 which is in engagement with post 122 of the male die support and guide pillar 138.

Upon completion of the piercing of the blank, cam 34 moves upward. As the cam moves upward, springs 64 push the die toward the right as viewed in FIGS. 6 and 7 until the slide comes into engagement with slide stop 178. At the same time, the sliding guide is moved toward the right by springs 170. The cam and the head continue their upward movement so that heads 149 come into engagement with the ram to lift head 28 with sliding guide 158 from the female die and the slide. The lifting of the head from the female die releases the female die so that the female die may be rotated in the circular die recess until the next die aperture is aligned with the male die and the die post assembly releasably holds the female die in the next position.

Once the female die is appropriately positioned, the ram is again moved downward with the guide stud and guide pillar being positioned in the forward opening and rear slot, respectively. The continued downward movement of the ram has the instant piercing die go through another cycle as described above.

The blank is rotated at the end of each cycle so that a sufficient number of holes are punched in the blank. The holes are punched through the blank from the interior of the blank to the outside, thereby giving a particularly desired result wherein the interior surface of the blank has the male die first engaging the interior surface rather than the exterior surface. The metal is cut from the blank by being pushed out from the inside out.

Figure 9:
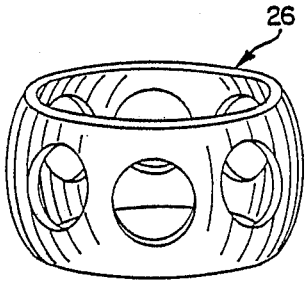
FIG. 9 is a perspective view of a workpiece made in the piercing die shown in FIG. 1.

Once the appropriate number of holes are punched in the blank and the ram is moved upward, the upper plate of the female die is lifted off the lower plate and the blank is removed. In this instance, the resulting workpiece is shown in FIG. 9. A new blank is then inserted in the blank receptacle. The upper plate is placed on top of the lower plate and the press is cycled an appropriate number of times with appropriate rotation of the female die to complete another workpiece.

Although the instant disclosure has described a blank which is a portion of a sphere and defining a closed figure, it is readily apparent that other shapes, such as, squares, triangles, and hexagons may be shapes of blanks which may be formed in the die. Furthermore, not only may circular holes be pierced, but slots or other shapes may be pierced using the instant invention. In addition, the male die may be split so that two or more holes may be pierced through a blank simultaneously.

Although a specific construction has been shown and described in detail above, it is readily apparent that those skilled in the art may make various modifications and changes without departing from the spirit and scope of the present invention. It is to be understood that the instant invention is limited only by the appended claims.

We claim:

1. A piercing die for piercing a hole in a blank having an open interior and an outer wall defining a closed figure from the interior of the blank out through the outer wall to the outside of the blank comprising, in combination, a base, a slide movably mounted on the base, a guide movably connected to the slide to control movement of the slide to a straight line movement, a hollow female die mounted on said base having an inner working supporting surface defining a receptacle for snugly holding a blank having an inside wall and an outside wall having a surface complementary to the work supporting surface a male die mounted on the slide, said female die having a cutting aperture intersecting the blank receptacle, said female die being split through said cutting aperture said male die being positioned within the blank receptacle of the female die and mateable with the cutting aperture of the female die to cut a hole in the blank positioned in the blank receptacle of the female die from the interior of the blank through the outer wall to the outside of the blank, and a cam connectable to the slide for moving the male die toward the female die to engage the blank and to cut the hole in the blank.

2. A piercing die for piercing a hole in a blank having an open interior and an outer wall defining a closed figure from the interior of the blank out through the outer wall to the outside of the blank as defined in claim 1, wherein said inner working supporting surface is spherical and snugly holds said blank, said blank complementary surface being spherical.

3. A piercing die for piercing a hole in blank having an open interior and an outer wall defining a closed figure from the interior of the blank out through the outer wall to the outside of the blank as defined in claim 1, wherein said female die is rotatably mounted on the base, said female die has at least one cutting aperture intersecting the blank receptacle, and said cutting aperture is selectively mateable with the male die for piercing the hole through the blank at said cutting aperture.

4. A piercing die for piercing a hole in a blank having a open interior and an outer wall defining a closed figure from the interior of the blank out through the outer wall to the outside of the blank as defined in claim 1, wherein said female die has a plurality of cutting apertures in substantially one plane for piercing the hole through the blank at each aperture, and said cutting apertures equiangularly positioned about a selected center.

5. A piercing die for piercing a hole in a blank having an open interior and an outer wall defining a closed figure from the interior of the blank out through the outer wall to the outside of the blank as defined in claim 1, wherein said female die has a plurality of the cutting apertures, each of said cutting apertures is selectively mateable with the male die for cutting the hole through the blank at each of the cutting apertures, and a releasable stop cooperative with the female die for selectively holding the female die at a selected position to hold a selected one of the cutting apertures in position mateable with the male die.

6. A piercing die for piercing a hole in a blank having an open interior and an outer wall defining a closed figure from the interior of the blank out through the outer wall to the outside of the blank as defined in claim 1, wherein said slide includes a post positioned in the blank receptacle, said male die is mounted on the post, and a portion of said guide is cooperative with the post to limit movement of the male die.

7. A piercing die for piercing a hole in a blank having an open interior and an outer wall defining a closed figure from the interior of the blank out through the outer wall to the outside of the blan as defined in claim 1, wherein said female die has a circular body and is rotatably mounted on the base.

8. A piercing die for piercing a hole in a blank having an open interior and an outer wall defining a closed figure from the interior of the blank out through the outer wall to the outside of the blank as defined in claim 1, including a spring return connected to the slide for moving the male die out of mateable engagement with one of the cutting apertures of the female die.

9. A piercing die for piercing a hole in a blank having an open interior and an outer wall defining a closed figure from the interior of the blank out through the outer wall to the outside of the blank as defined as claim 1, wherein said female die has a plurality of the cutting apertures intersecting the blank receptacle, said male die is selectively mateable with each of the cutting apertures for cutting the hole through the blank at each of the cutting apertures, and said female die is split through the cutting apertures on a plane substantially parallel to the base for insertion and removal of the blank into and out of the blank receptacle of the female die.

10. A piercing die for piercing a hole in a blank having an open interior and an outer wall defining a closed figure from the interior of the blank out through the outer wall to the outside of the blank as defined in claim 1, wherein said female die has a plurality of the cutting apertures intersecting the blank receptacle, said female die is rotatably mounted on the base, said slide includes a post positioned in the blank receptacle of the female die, said male die is mounted on the post and being selectively mateable with each of the cutting apertures for cutting the hole through the blank at each of the cutting apertures, said female die is split through the cutting apertures on a plane substantially parallel to the base for insertion and removal of the blank into and out of the blank receptacle of the female die, and a portion of said guide is cooperative with the post for limiting movement of the post.

11. A piercing die for piercing a hole in a blank having an open interior and an outer wall defining a closed figure from the interior of the blank out through the outer wall to the outside of the blank as defined in claim 1, wherein said female die has a plurality of the cutting apertures intersecting the blank receptacle, said female die has a circular body and being rotatably mounted on the base having the center of rotation within the blank receptacle, each of said cutting apertures is selectively mateable with the male die for forming the hole through the blank at each of the cutting apertures, and said female die is split through the cutting apertures for insertion and removal of the blank into and out of the blank receptacle of the female die.

12. A piercing die for piercing a hole in a blank having an open interior and an outer wall defining a closed figure from the interior of the blank out through the outer wall to the outside of the blank as defined in claim 1, wherein said female die is split through the cutting apertures for insertion and removal of the blank into and out of the blank receptacle of the female die; and including, a spring return connected to the slide for moving the male die out of mateable engagement with the cutting apertures of the female die, a post mounted on the slide supporting the male die, a guide stud mounted on the post, a guide pillar mounted on the slide, a guide runner releasably connectable to the guide stud and the guide pillar for limiting movement of the male die, and a head movably holding the guide runner to limit movement of the guide runner to a substantially straight line movement, and said head is adapted for connection to a ram of a press and being connectable to the female die to hold the female die together while the male die cuts the hole in the blank.

13. A piercing die for piercing a hole in a blank having an open interior and an outer wall defining a closed figure from the interior of the blank out through the outer wall to theo utside of the blank as defined in claim 1, wherein said female die has a plurality of cutting apertures intersecting the blank receptacle, said cutting apertures are equiangularly positioned about a selected center within the blank receptacle, said cutting apertures are in substantially one plane, said female die is rotatably mounted on the base having its center of rotation coincidental with the center about which the cutting apertures are equiangularly positioned, and each of the cutting apertures are selectively mateable with the male die for forming the hole through the blank at each cutting aperture.

14. A piercing die for piercing a hole in a blank having an open interior and an outer wall defining a closed figure from the interior of the blank out through the outer wall to the outside of the blank as defined in claim 1, wherein the female die has a substantially circular body and is rotatably mounted on the base having its center of rotation positioned within the blank receptacle, said female die has a plurality of cutting apertures intersecting the blank receptacle, each of said cutting apertures are selectively mateable with the male die, and a release stop is cooperative with the female die for selectively holding the female die at a selected rotated position to hold one of the selected cutting apertures in position for mating with the male die for piercing the hole through the blank at each cutting aperture.

15. A piercing die for piercing a hole in a blank having an open interior and an outer wall defining a closed figure from the interior of the blank out through the outer wall to the outside of the blank as defined in claim 1, wherein said female die has a plurality of the cutting apertures intersecting the blank receptacle, said cutting apertures are equiangularly positioned about a selected center positioned in the blank receptacle, said female die is rotatably mounted on the base, each of the cutting apertures are selectively engageable with the male die for piercing the hole through the blank at each cutting aperture and being disposed in substantially one plane, and said female die is split through the cutting apertures on a plane substantially parallel to the base for insertion of the blank into the blank receptacle of the female die, holding snugly of the blank within the blank receptacle of the female die and removal of the blank out of the blank receptacle of the female die.

16. A piercing die for piercing a hole in a blank having an open interior and an outer wall defining a closed figure from the interior of the blank out through the outer wall to the outside of the blank as defined in claim 1, wherein said female die has a plurality of cutting apertures intersecting the blank receptacle, said cutting apertures are equiangularly positioned about a selected center position in the blank receptacle, and a release stop is cooperative with the female die for selectively holding the female die at a selected position to hold a selected cutting aperture in a position for mating with the male die for piercing the hole through the blank at each cutting aperture.

17. A piercing die for piercing a hole in a blank having an open interior an outer wall defining a closed figure from the interior of the blank out through the outer wall to the outside of the blank as defined in claim 1, wherein said female die has a plurality of cutting apertures intersecting the blank receptacle, said cutting apertures are equiangularly positioned about a selected center positioned in the blank receptacle, said female die is rotatably mounted on the base rotating about the selected center, said slide includes a post positioned in the blank receptacle, said male die mounted on the post and being selectively mateable with each of the cutting apertures for piercing the hole through the blank at each cutting aperture, a guide stud mounted on the post, a guide pillar mounted on the slide, a guide runner releasably connectable to the guide stud and the guide pillar for limiting movement of the male die, and a head is movably holding the guide to limit movement of the guide runner to a substantially straight line movement, and said head is adapted for connection to a ram of a press and being connectable to the female die to hold the female die together while the male die cuts the hole in the blank.

18. A piercing die for piercing a hole in a blank having an open interior and an outer wall defining a closed figure from the interior of the blank out through the outer wall to the outside of the blank as defined in claim 1, wherein said female die has a plurality of cutting apertures intersecting the blank receptacle, said female die being rotatably mounted on the base having its center of rotation within the blank receptacle, said cutting apertures equiangularly positioned about the center of rotation of the female die, said slide including a post positioned in the blank receptacle, and said male die is mounted on the post, and a release stop is cooperative with the female holding the female die at selected positions to hold the selected ones of the cutting apertures in position mateable with the male die for piercing the hole through the blank at each of the cutting apertures.

19. A piercing die for piercing a hole in a blank having an open interior and an outer wall defining a closed figure from the interior of the blank out through the outer wall to the outside of the blank as defined in claim 1, wherein said female die has an annular body and is rotatably mounted on the base having its center of rotation in the center of the blank receptacle, said female die has a plurality of the cutting apertures intersecting the blank receptacle, said cutting apertures equiangularly positioned about the center of rotation of the female die, said cutting aperture in substantially one plane, said female die is split through the center of the cutting apertures on a plane substantially parallel to the base for insertion and removal of the blank into and out of the blank receptacle of the female die, and a releasable stop is cooperative with the female die for selectively holding the female die at selected positions to hold selected cutting apertures in position for mating with the male die for piercing the hole through the blank at each of the cutting apertures.

20. A piercing die for piercing a pluraliyt of holes in a blank having a convex outer wall forming a closed figure from the inside of the blank tubing out toward the outside of the blank comprising, in combination, a base having a slide groove contained therein and being adapted for mounting on a press, a slide having a portion slideably mounted in the slide groove of the base and being slidable on the base, a guide removably mounted on the base and being positioned on a pair of pins, said guide having a guide groove substantially parallel to the slide groove in the base, a hollow female die having an inner spherical work supporting surface defining a receptacle for snguly holding a blank having an inside wall and an outside wall having a spherical surface complementary to the work supporting surface, a male die, said female die rotatably mounted on the base having its center of rotation at the center of the blank receptacle, said female die having a plurality of cutting apertures extending radially from the blank receptacle and intersecting the blank receptacle, each of said cutting apertures being equiangularly positioned about the center of rotation of the female die, a post fixed to the slide and being positioned in the blank receptacle of the female die, a guide stud mounted on the post, a guide pillar mounted on the slide, a guide runner releasably connected to the guide stud and the guide pillar for limiting movement of the post to a straight line movement on substantially the diameter of the blank opening, the male die mounted on the post and being selectively mateable with each of the cutting apertures of the female die to cut the hole in the blank positioned in the blank receptacle from the inside of the blank toward the outside of the blank, said cutting apertures being disposed in substantially one plane, said inner work supporting surface snguly holds said blank, a releasable stop cooperative with the female die holding the female die at selected positions to hold selected cutting apertures in position mateable with the male die, a head movably holding the guide runner to limit movement of the guide runner, said head being adapted for connection to a ram of the press and being connectable to the female die to hold the female die together while the male die cuts the hole in the blank, a cam adapted for connection to the ram of the press connectable to the slide for moving the slide and the male die toward the female die to engage the blank and to cut the hole in the blank, and a spring return connected to the slide for moving the male die out of mateable engagement with the cutting apertures of the female die.

* * * * *